US006199488B1

(12) United States Patent
Favaron et al.

(10) Patent No.: US 6,199,488 B1
(45) **Date of Patent: *Mar. 13, 2001**

(54) REINFORCED PLASTIC PALLETS

(76) Inventors: James Favaron, One Colonial Dr., Clifton Park, NY (US) 12065; Robert Funk, 3670 212th La. NW., Anoka, MN (US) 55303; Bruce Settergren, 1822 253rd Ave. N., Mora, MN (US) 55051

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/946,013

(22) Filed: Oct. 7, 1997

(51) Int. Cl.[7] ..... B65D 19/38
(52) U.S. Cl. ..... 108/57.25; 108/901
(58) Field of Search ..... 108/57.25, 57.26, 108/901, 902, 56.1, 51.11

(56) References Cited

U.S. PATENT DOCUMENTS

| | | | | |
|---|---|---|---|---|
| 3,664,271 | * | 5/1972 | Wolder et al. | 108/57.26 |
| 3,964,400 | * | 6/1976 | Brand | 108/57.25 |
| 4,051,787 | * | 10/1977 | Nishitani et al. | 108/901 X |
| 4,103,857 | * | 8/1978 | Levenhagen | 108/901 X |
| 4,316,419 | | 2/1982 | Wavin . | |
| 4,397,246 | * | 8/1983 | Ishida et al. | 108/901 X |
| 4,735,154 | | 4/1988 | Allibert . | |
| 5,117,762 | * | 6/1992 | Shuert | 108/57.25 |
| 5,404,829 | * | 4/1995 | Shuert | 108/57.26 |
| 5,413,052 | * | 5/1995 | Breezer et al. | 108/57.25 X |
| 5,596,933 | * | 1/1997 | Knight et al. | 108/901 X |

FOREIGN PATENT DOCUMENTS

| | | |
|---|---|---|
| 3627497 | 2/1988 | (DE) . |
| 0 226 505 | 6/1987 | (EP) . |
| 2310277 | 12/1976 | (FR) . |
| 2 334 574 | 7/1977 | (FR) . |
| 2209321 | 10/1999 | (GB) . |

* cited by examiner

*Primary Examiner*—Jose V. Chen
(74) *Attorney, Agent, or Firm*—Mintz, Levin, Cohn, Ferris, Glovsky and Popeo P.C.

(57) ABSTRACT

A reinforced plastic pallet is disclosed. The pallet is characterized in that it is formed of an upper deck, a lower deck, and reinforcing elements. The reinforcing elements are retained on the lower deck in a manner that allows relative movement between the reinforcements and the deck.

17 Claims, 8 Drawing Sheets

REINFORCED PLASTIC PALLETS

FIELD OF THE INVENTION

The present invention relates generally to pallets for storing and transporting goods, and more particularly, to reinforced plastic pallets in which the reinforcements are not rigidly fixed to the pallet body.

BACKGROUND OF THE INVENTION

It is well known to use pallets for the transportation and storage of goods. Palletized goods are typically maintained in position above a floor for handling by forklift equipment, i.e., through the insertion of forklift tines into channels formed in the pallet or through engagement with the undersurface of the top deck of the pallet.

Pallets have traditionally been formed of wood. Wood pallets, however, have many disadvantages. For example, they are subject to breakage and are therefore reusable only over a short period of time. Wooden pallets are also difficult to maintain in a sanitary condition, thereby limiting their usability in applications in which sanitation is important, such as in food-handling applications.

In the past decades, with the growth of the plastics industry, a wide variety of plastics have been investigated to determine their suitability for use in producing pallets. Plastic pallets can easily be molded and are stronger and lighter in weight than wooden pallets. They can also be formed from materials capable of being recycled. Furthermore, plastic pallets are more durable than wooden pallets.

Despite their advantages, plastic pallets have only been used to a limited degree. Although plastic pallets heretofore have been generally durable, have been reusable over an extended period of time and have been easy to maintain in a sanitary condition, they have suffered from the disadvantage that they are generally more expensive than wooden pallets. Although manufacturing costs are reflected in the cost of plastic pallets, a principal reason that plastic pallets cost considerably more than comparable wooden pallets is that they require a given amount of a relatively expensive plastic material for a desired measure of pallet strength.

Another significant issue with plastic pallets is the tendency of payload to slip on the plastic pallet and of the pallet to move either relative to forklift tines or a transport surface, (i.e., the floor of a transport vehicle). Obviously, if payload slips on a plastic pallet, or if the pallet tends to slide relative to forklift tines or a transport surface, the commercial applicability of the pallet will be limited.

In view of the above, a need exists for a plastic pallet having a high strength to weight ratio, reduced cost of manufacture, and an anti-slip design. The structures presented herein are intended to address these needs.

SUMMARY OF THE INVENTION

In its broadest form, the invention relates to an improved plastic pallet. More particularly, the invention relates to a reinforced plastic pallet having an upper deck formed of a plastic material. The upper deck has an upper surface, a lower surface, a front edge, a back edge which is substantially parallel to the front edge, and first and second side edges which are substantially parallel to one another. The upper deck further includes a plurality of legs extending substantially perpendicularly downward from the lower surface. Additionally, the pallet includes a lower deck formed of a plastic material. The lower deck has an upper surface, a lower surface, a front edge, a back edge which is substantially parallel to the front edge, and first and second side edges which are substantially parallel to one another. The lower deck further includes a plurality of sockets, each sized and positioned to mate with the legs extending from the upper deck.

The lower deck also includes a plurality of channels formed in its upper surface. The channels are configured in a manner which allows relative movement between the channel and a reinforcing element positioned in the channel. In one embodiment, the channels optionally may be provided with a plurality of retainers to retain a reinforcing element. In allowing relative movement between a channel and a reinforcing element, the pallet allows for differing degrees of thermal expansion and contraction, or other movement that may exist between the material forming the decks and the material forming the reinforcement elements. As noted above, the reinforcement elements can be maintained in the channels by retainers which extend from the channel walls into the channel spaces. Such retainers are preferably staggered along alternate sides of the channels. In one preferred embodiment, the channels are positioned on the upper surface of the bottom deck about the peripheral edges thereof. Additional channels extending perpendicularly from the center of each edge channel toward the center of the deck are provided as well.

The reinforcing elements are preferably composite structural members of a fiberglass reinforced plastic formed by a pultrusion process. The reinforcement members may be of a wide variety of configurations, however, bars having an I-shaped cross section are preferred.

BRIEF DESCRIPTION OF THE DRAWINGS

These and other features, aspects and advantages of the present invention will be more fully understood from the following detailed description of certain preferred embodiments when read in conjunction with the accompanying drawings in which.

In the drawings, like reference numbers designate like parts in various views.

DETAILED DESCRIPTION OF THE INVENTION

Figure 1:
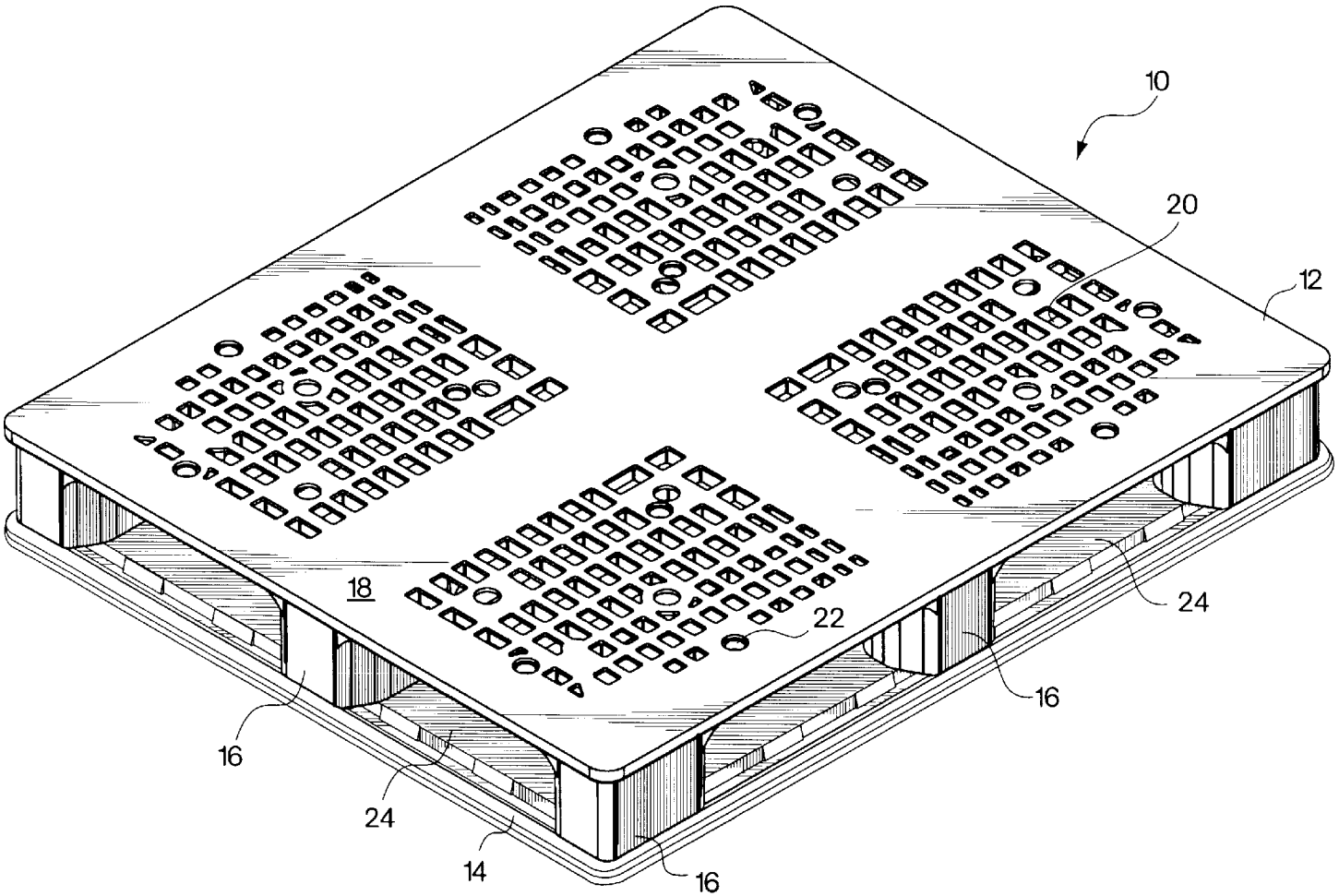
FIG. 1 is an isometric view of the top of the pallet of the invention.

The present invention relates to a reinforced plastic pallet, one embodiment of which is shown in FIG. 1. FIG. 1 is a top isometric view of the pallet 10 which includes an upper deck 12 and a lower deck 14. The upper deck is a generally rectangular shaped molded plastic body supported by legs 16 which extend substantially perpendicularly downward from the underside of the upper deck 12. In one preferred embodiment, nine legs are provided; one at each of the four corners of the deck, one at the approximate midpoint of each edge of the deck, and one at the center of the deck. It should be understood, however, that the invention is not intended to be limited by the specific number and position of the legs described herein.

The top surface 18 of the upper deck is provided with a plurality of apertures 20. The apertures 20 serve to provide drainage for goods positioned on the deck, and at the same time help to minimize the overall weight of the pallet. The top surface 18 is further provided with a plurality of anti-slip plug apertures 22, into which may be placed a high friction material. As will be discussed in detail below, the anti-slip plugs serve to prevent slippage of goods stored on the pallet, as well as preventing slippage of the pallet relative to a transport mechanism, such as the tines of a forklift vehicle.

As can be seen in FIG. 1, the pallet further includes numerous transport apertures 24, defined by the space created between adjacent legs and the upper and lower decks. These transport apertures are sized and positioned in a manner to make them compatible with a wide variety of forklift and other transport equipment.

Figure 2:
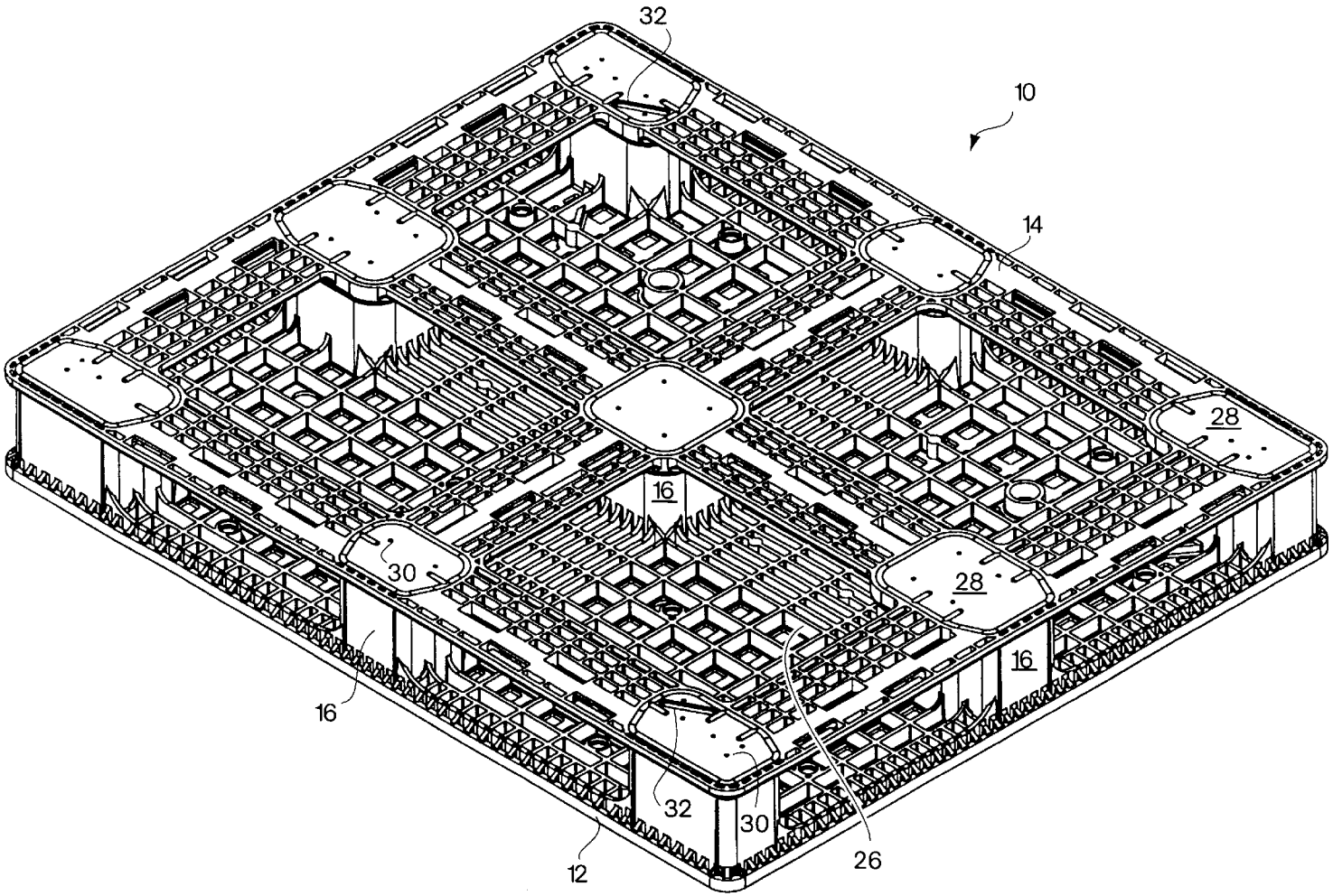
FIG. 2 is an isometric view of the bottom of the pallet of the invention.

FIG. 2 is a bottom isometric view of the pallet 10 of FIG. 1. Each of the preferred nine legs 16 can be seen in FIG. 2, as well as numerous supporting ribs which provide strength to the structure while minimizing its overall weight. In addition, FIG. 2 allows the underside of sockets 28 to be viewed. The sockets 28, provided on the lower deck 14, are sized and positioned to receive the bottom portion of the legs 16 extending from the upper deck 12. Each of the sockets 28 is provided with drains 30 which prevent fluid from collecting in the legs 16. The bottom deck 14 is also provided with card slots 32, positioned in two opposing corner legs, through which various pallet identification devices may be inserted. In one preferred embodiment, radio-frequency identification cards are used to allow the pallet, and its goods, to be quickly and simply identified.

Figure 3:
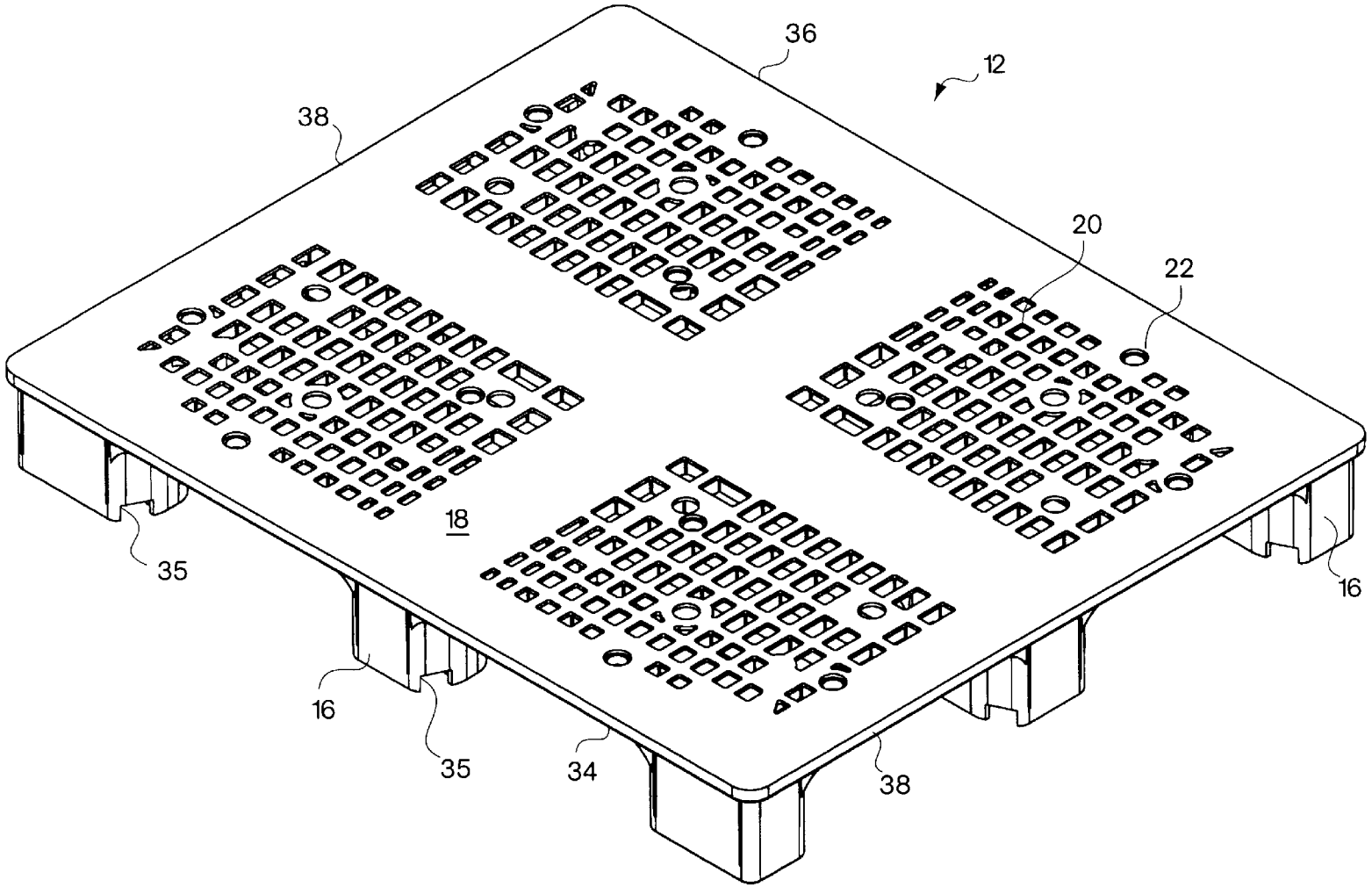
FIG. 3 is an isometric view of the top of the upper deck of the pallet of the invention.

As noted above, the pallet of the present invention includes three primary structural components: an upper deck, a lower deck, and reinforcing elements. The upper deck 12, separated from the other components, is shown in FIG. 3. In FIG. 3, the top surface 18 of the deck, and five of the legs 16, are readily visible. Each of the legs includes slots 35 to accommodate reinforcing elements positioned between the upper and lower decks. A discussion of the specifics of the placement of the reinforcing elements and their relationship to the upper and lower decks is provided below.

In one preferred embodiment, the top surface 18 has dimensions of approximately 48 inches by approximately 40 inches, defining a surface of approximately 1920 square inches. Of course, it is noted that the invention is not in any way intended to be limited to pallets of those specific dimensions. The upper deck is preferably formed of a molded high density polyethylene. This material is preferred because of its relative strength and weight characteristics. For ease of definition herein, the edges of the upper deck are designated as a front edge 34, a substantially parallel rear edge 36, and opposed, substantially parallel side edges 38. Each of the side edges 38 extends substantially perpendicularly from the front 34 and rear 36 edges.

Figure 4:
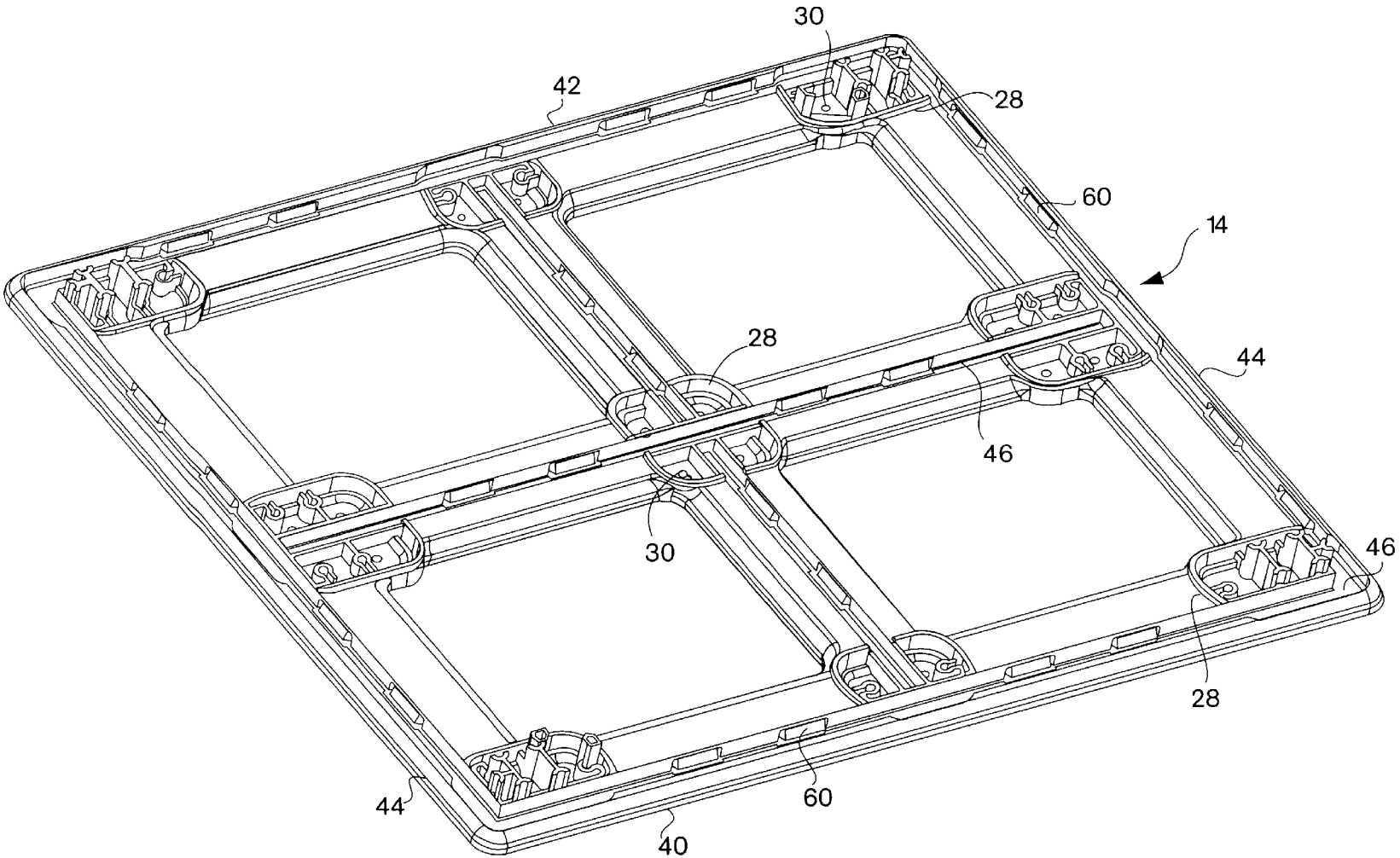
FIG. 4 is an isometric view of the top of the lower deck of the pallet of the invention.
Figure 5:
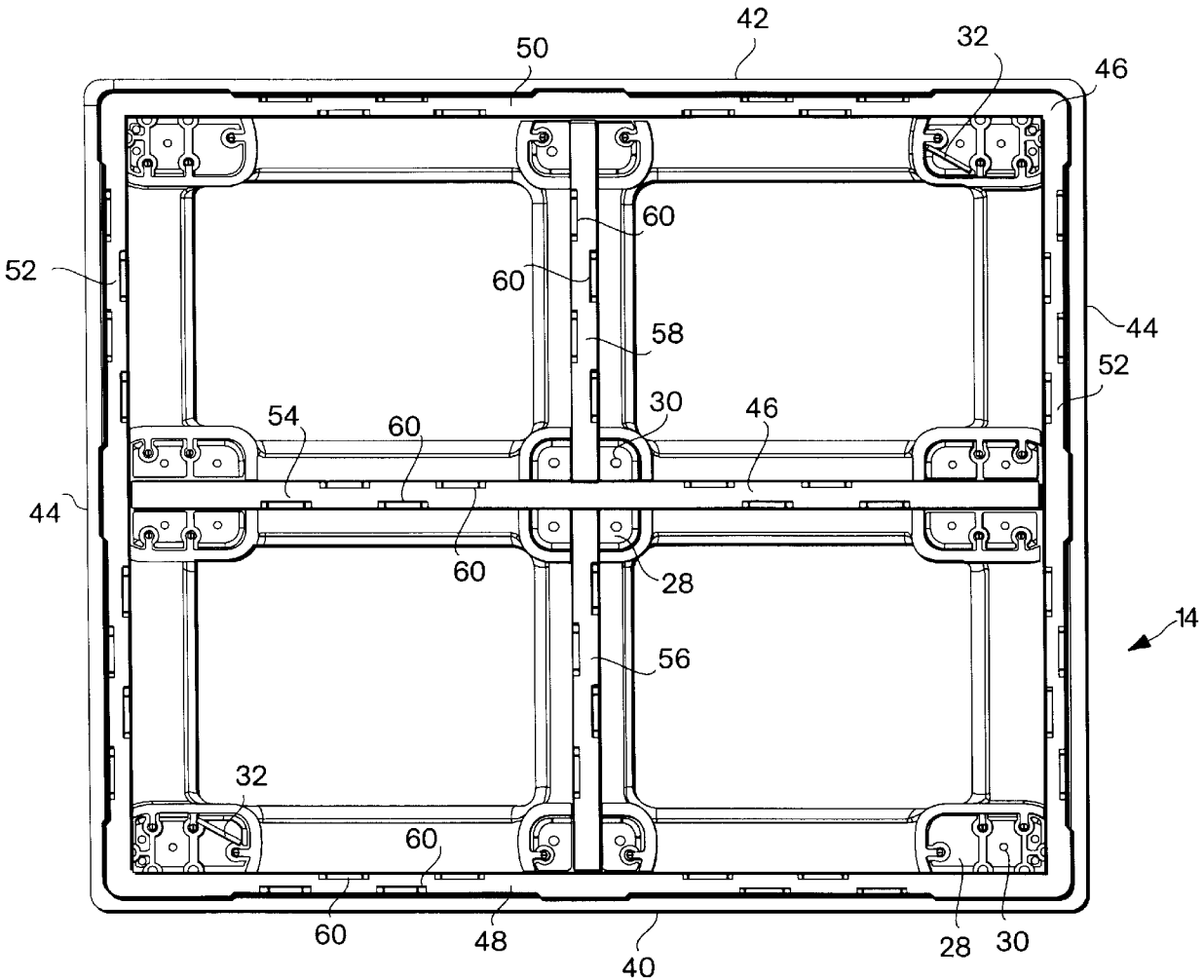
FIG. 5 is a top view of the lower deck of the pallet of the invention.

The lower deck 14 of the pallet 10 is shown in FIGS. 4 and 5. FIG. 4 is an isometric view of the lower deck, and FIG. 5 is a top view. The lower deck 14 has similar dimensions to the upper deck and is preferably formed of the same material. Likewise, the lower deck 14 includes a front edge 40, a substantially parallel rear edge 42, and opposed, substantially parallel side edges 44. Each of the side edges 44 extends substantially perpendicularly from the front 40 and rear 42 edges. The lower deck includes sockets 28 which are sized and positioned to receive the legs 16 which extend downward from the upper deck 12. Like the legs 16, preferably nine sockets 28 are provided; one at each of the four comers of the deck, one at the approximate midpoint of each edge of the deck, and one at the center of the deck.

Additionally, as may best be seen in FIG. 5, the lower deck 14 is provided with channels 46 in which reinforcement elements are retained. In particular, the lower deck 14 includes a front channel 48 running substantially parallel to the front edge 40, a rear channel 50 running substantially parallel to the rear edge 42, and side channels 52, each running substantially parallel to the side edges 40. In addition, the lower deck is provided with a horizontal, or central, channel 54 running from substantially the midpoints of the side channels through the socket 28 in the center of the lower deck 14, a lower vertical channel 56 running from the substantial midpoint of the front channel 48 to the horizontal channel 54, and an upper vertical channel 58 running from the substantial midpoint of the front channel 48 to the horizontal channel 54. The upper and lower vertical channels may also be referred to as "sub-central" channels. The horizontal channel 54 is substantially parallel to the front 48 and rear 50 channels, and the lower 56 and upper 58 vertical channels are substantially parallel to the side channels 52.

It should also be noted that the invention is not intended to be limited strictly to a configuration in which the horizontal channel extends through the center and the upper and lower channels extend only to the center. Rather, a vertical channel extending between the front and rear edges of the deck could be provided in combination with a left horizontal channel and a right horizontal channel which extend from their respective side edges to the center. For purposes of definition herein, the channel that extends between two edges and through the center of the lower deck is referred to as the central channel, and the channels that extend from their respective edges to the center of the lower deck are referred to as the sub-central channels.

Each of the channels optionally may be provided with a series of retainers 60 at points along its length. Each of the retainers 60 extends into the channel and serves to provide an interference region which will prevent the reinforcement element from rising upward out of the channel. However, the retainers 60 are configured to allow some degree of lateral movement of the reinforcement elements within the channels, thereby preventing stresses that can occur if the deck material is subject to movement of a different extent than that of the reinforcement element. For example, if the deck is caused to undergo a greater degree of thermal expansion than the reinforcement element, since the element is not rigidly fixed to the deck, these thermally-induced stresses are prevented or relieved.

The retainers 60 are preferably staggered within the channels as shown in FIG. 5. In one preferred embodiment, each retainer is approximately 2 inches in length, and each channel segment between each socket includes four retainers, two on each side of the channel. Of course, it is intended that different sized retainers can be used, and that the retainers need not be staggered, but rather may be opposing across each channel.

Figure 6:
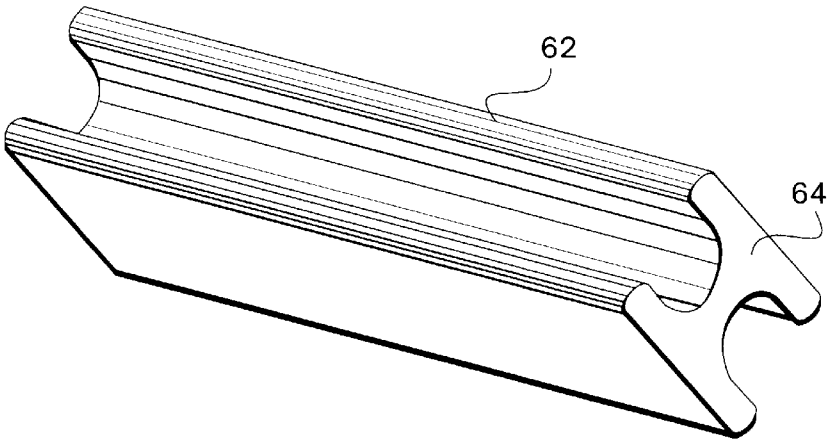
FIG. 6 is an isometric view of a portion of a reinforcing element for use in the pallet of the invention.

FIG. 6 is a representation of a segment of a reinforcing element 62. The reinforcing element 62 preferably has an I-shaped cross section 64, although other cross sections are envisioned as well. The reinforcing element is formed of a composite material such as a fiberglass reinforced thermosetting plastic fabricated using a pultrusion process. The pultrusion process is well known and described, for example, in a) "Introduction to Pultrusion", Creative Pultrusions, Inc. Design Guide, pp. 1.1–1.6, October 1990, and b) Morrison Molded Fiberglass Company product literature "Dura Grid Customer Fiberglass Grids and Gratings", pp. 1–7, 9, August 1995, both of which are incorporated herein by reference. Preferably, the composite is formed of straight strands of glass fibers that have been wrapped by a glass sleeving and combined with an epoxy resin during the pultrusion process. In such a process, the base material, i.e., the glass fiber bundle, is pulled through a liquid resin bath and then into a heated shaping die in which the resin is thermoset. The result is a continuous solid part in the shape of the cavity of the die.

The resulting reinforcement bars provide significant advantages over reinforcement elements such as steel, aluminum, or wood structural members that have been used in the past because they offer an improved strength to weight ratio, corrosion resistance, compatible thermal expansion rates, and a low flexural modulus which allows the reinforcement elements of the present invention to flex back into position rather than deforming if they are deformed by excess weights.

Figure 7:
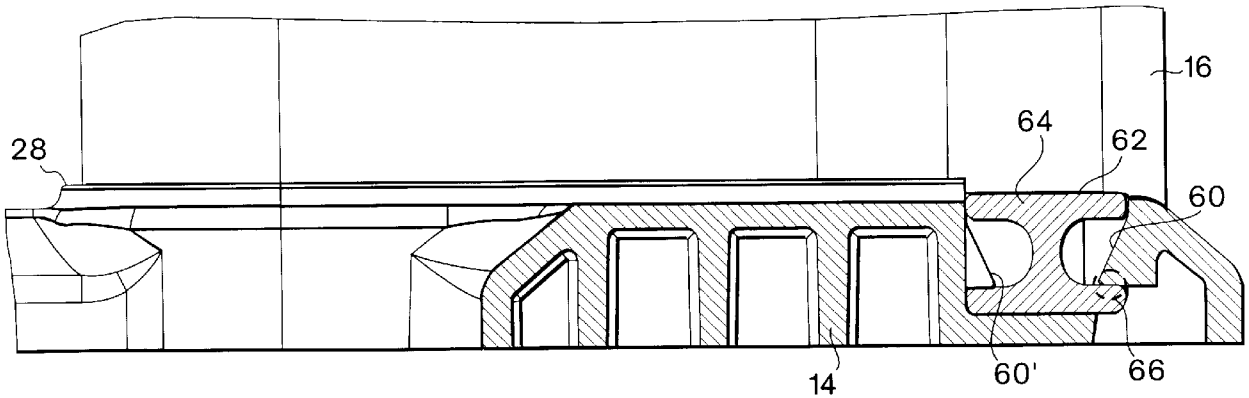
FIG. 7 is a schematic cross-sectional representation of a reinforcing element retained within a channel on the lower deck of a pallet of the invention

A cross-sectional view of a reinforcing element positioned within a channel is shown schematically in FIG. 7. In FIG. 7, the reinforcing element 62 has been positioned within a channel 46 of the lower deck 14, and one leg 16 of the upper deck has been inserted into its respective socket 28 in the lower deck 14. One retainer 60 is shown engaging a portion of the I-shaped cross section 64 of the reinforcing element 62 at region 66. It can be noted from the Figure that, while upward movement of the reinforcing element 62 is prevented by interference with retainer 60, lateral movement of the reinforcing element 62, (i.e., movement of the reinforcing element along a line perpendicular to the page), is still available. Interference between the reinforcing element 62 and the leg 16 is avoided by way of the slots 35 that have been provided in the leg. These slots 35, (best seen in FIG. 3), provide an opening in the leg which cooperates with each channel 46 as it passes through a socket 28, and thereby allows the leg to be positioned in the socket and the reinforcing element to be positioned in the channel as it passes through the socket.

As noted above, the optional opposing retainers 60 are preferably staggered along the length of the channel. One such staggered retainer 60' is represented in FIG. 7. It is the intent of the Figure that retainer 60' is positioned behind the plane representing crosshatched surfaces of the lower deck 14 and the reinforcing element 62.

The pallets of the present invention are assembled by positioning the various reinforcing elements within their respective channels in the lower deck, and then positioning the upper deck over the lower deck so that the legs are received in each of their respective sockets. The lower deck and upper deck can then be secured together by any of a wide variety of methods known in the art. For example, they may be bolted together, secured using an adhesive, or joined using any of the various methods known for welding plastic surfaces. In one embodiment, the use of a sonic weld is preferred.

Figure 8:
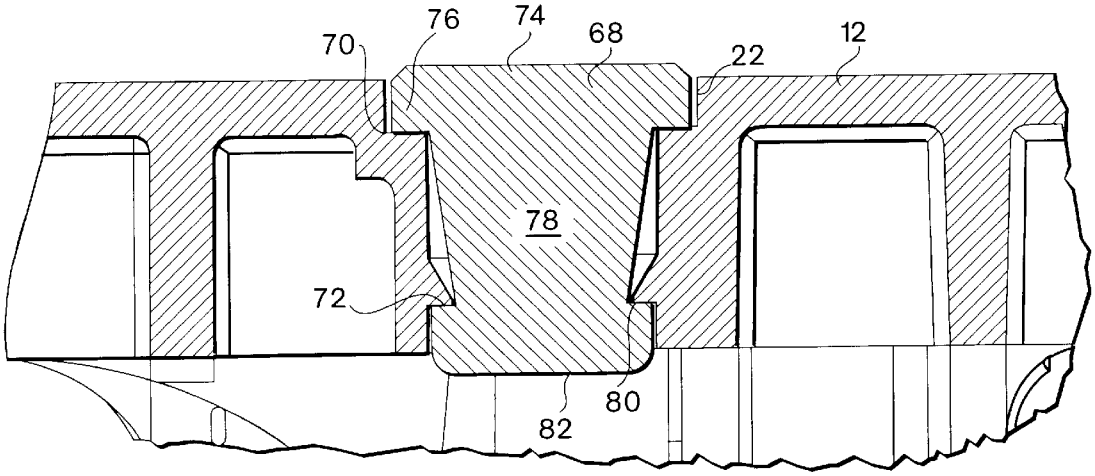
FIG. 8 is a schematic representation of an anti-slip plug inserted into a portion of the upper deck of the pallet of the invention.

The upper deck 12 of the pallets has been provided with several anti-slip plug apertures 22. Each such aperture is substantially circular and extends entirely through the upper deck. These apertures have been provided to allow anti-slip plugs to be provided on the pallet as shown in FIG. 8. In FIG. 8, an anti-slip plug aperture 22 having an anti-slip plug 68 inserted is shown. The aperture 22, includes a ledge 70 positioned near its upper portion and a retainer ring 72 positioned near its lower portion. The anti-slip plug is a substantially cylindrical element having a top 74, an upper collar 76, a tapered body portion 78, a lower collar 80 and a bottom 82. The anti-slip plug 68 is fabricated of a resilient, high friction material, such as rubber or the like. The plug 68 is inserted into the anti-slip plug aperture 22 until the lower collar 80 is engaged by the retainer ring 72. The plug is sized such that upon engagement of the lower collar by the retainer ring, the upper collar 76 will be in contact with the ledge 70. Additionally, the plug 68 is sized such that the top 74 extends a short distance above the top of the upper deck and the bottom 82 extends a short distance below the bottom of the upper deck. The top 74 is thus in a position to prevent goods stored on the pallet from sliding and the bottom 82 is in a position to prevent the pallet from sliding relative to a transport mechanism such as the tines of a forklift vehicle. The anti-slip apertures 22 and plugs 68 are positioned on the upper deck in a manner such that any standard transport mechanism which makes use of the transport apertures 24 will contact the bottom 82 of an anti-slip plug 68, and thus be provided with its benefit.

Figure 9:
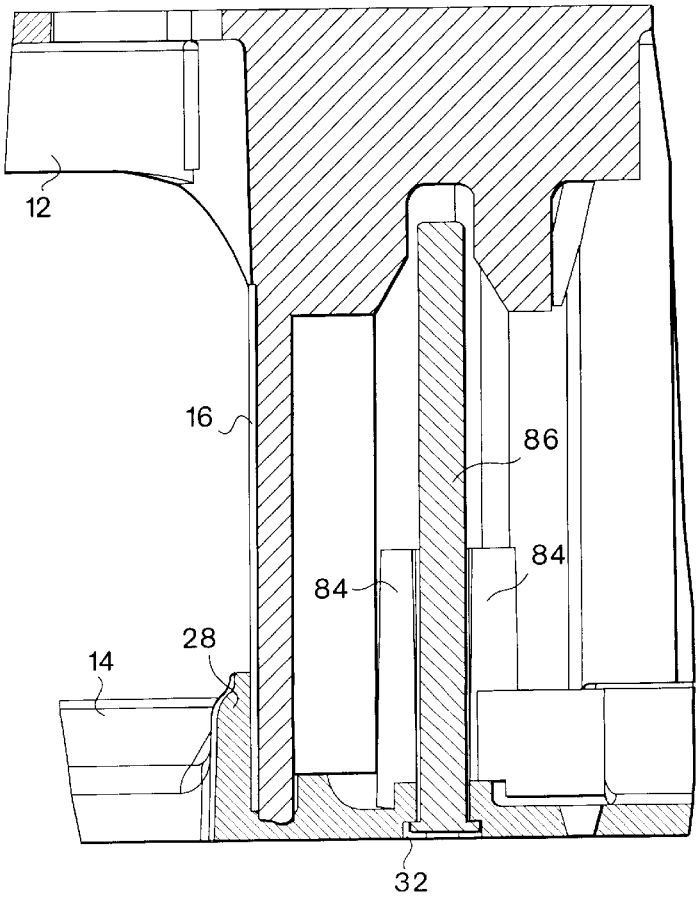
FIG. 9 is a schematic representation of a radio-frequency identification card inserted into a portion of the pallet of the invention.

As noted above, the pallets of the present invention can be provided with radio-frequency identification cards. One embodiment is shown in FIG. 9. In FIG. 9, a socket 28 of the lower deck 14 has been provided with card retainer walls 84 which are positioned adjacent to a card slot 32. The wall rise substantially perpendicular from the long edges of the slot and serve to support a radio-frequency identification card 86 which has been inserted into the slot. The leg 16, extending downward from the upper deck 12 further encloses and protects the card 86 from damage. By providing such cards, the pallets and their contents may be quickly and easily identified through manual or automated means. As noted above, it is preferred that the pallet is provided with two cards, one each at opposing corners. Thus, for example, a card may be provided in the left front corner and the right rear corner of the pallet. As such, a card will always be positioned at the left corner of the edge facing a detection mechanism, whether the pallet is approached from the portion designated the front or the portion designated the rear. Furthermore, it is preferred that such cards be positioned at an angle, rather than parallel to the sides. In so doing, some portion of the plane of the card, rather than just an edge, will be directed toward a detector, regardless of whether the detector is positioned along the front or the side of the pallet. In one preferred embodiment, the card is rotated to cause the plane of the card to form an angle of approximately 37° relative to the front edge of the pallet.

Figure 10:
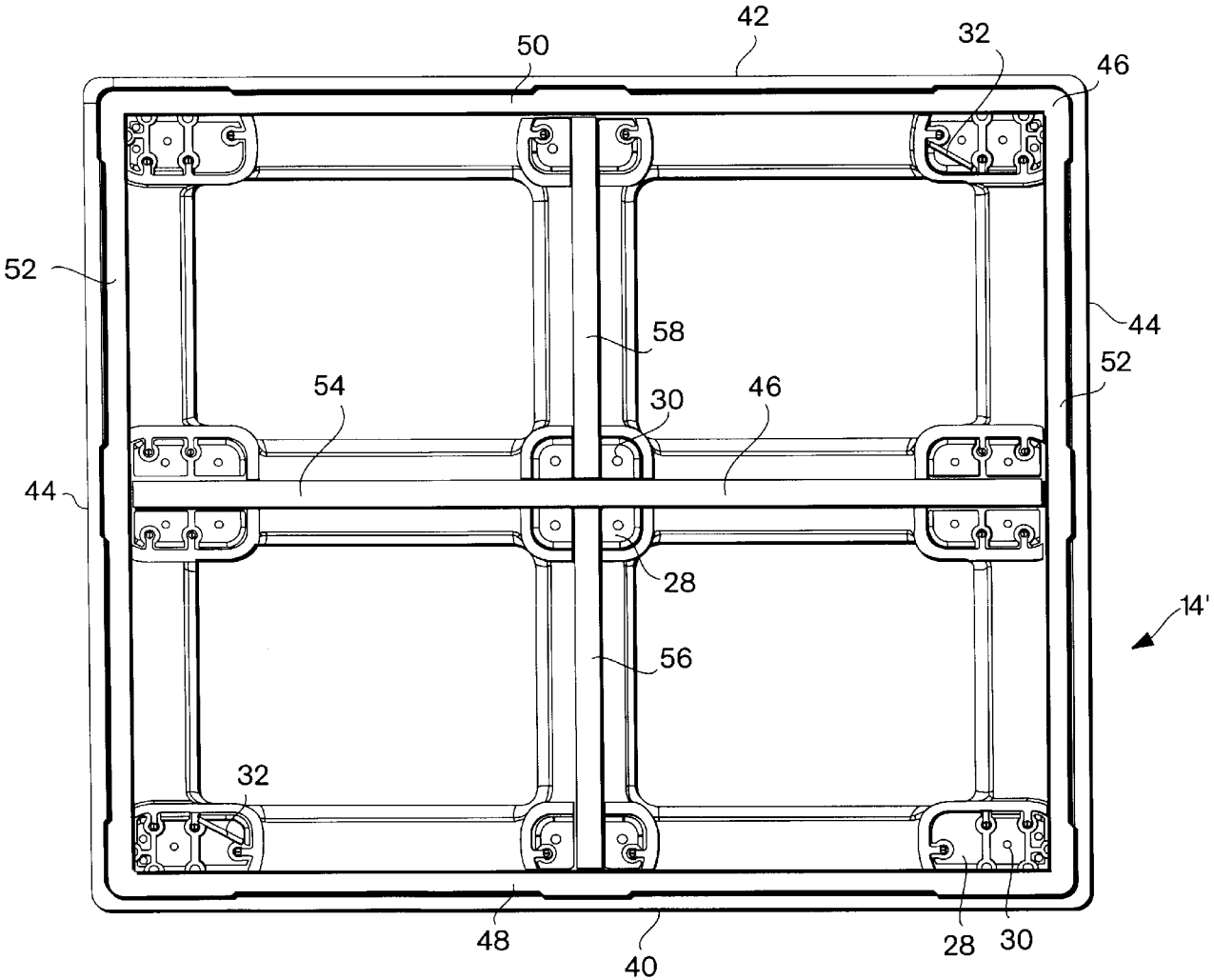
FIG. 10 is a top view of a second embodiment of the lower deck of the pallet of the invention.

As noted above, the use of retainers 60 to maintain the reinforcing elements 62 within their channels 46 is optional. Thus, in one embodiment, depicted in FIG. 10, no retainers are present. FIG. 10 depicts a lower deck 14' of a pallet that is substantially identical to that shown in FIGS. 4 and 5 with the exception that the lower deck of The lower deck 14' of FIG. 10 does not include the retainers 60. Like FIGS. 4 and 5, the lower deck 14' includes a front edge 40, a substantially parallel rear edge 42, and opposed, substantially parallel side edges 44. Each of the side edges 44 extends substantially perpendicularly from the front 40 and rear 42 edges. The lower deck includes sockets 28 which are sized and positioned to receive the legs 16 which extend downward from the upper deck 12. Like the legs 16, preferably nine sockets 28 are provided; one at each of the four comers of the deck, one at the approximate midpoint of each edge of the deck, and one at the center of the deck.

Additionally the lower deck 14' is provided with channels 46 in which reinforcement elements are positioned. In particular, the lower deck 14' includes a front channel 48 running substantially parallel to the front edge 40, a rear channel 50 running substantially parallel to the rear edge 42, and side channels 52, each running substantially parallel to the side edges 40. In addition, the lower deck is provided with a horizontal, or central, channel 54 running from substantially the midpoints of the side channels through the socket 28 in the center of the lower deck 14', a lower vertical channel 56 running from the substantial midpoint of the front channel 48 to the horizontal channel 54, and an upper vertical channel 58 running from the substantial midpoint of the front channel 48 to the horizontal channel 54. The upper and lower vertical channels may also be referred to as "sub-central" channels. The horizontal channel 54 is substantially parallel to the front 48 and rear 50 channels, and the lower 56 and upper 58 vertical channels are substantially parallel to the side channels 52.

As was the case with the lower deck 14 depicted in FIGS. 4 and 5, the invention is not intended to be limited strictly to a configuration in which the horizontal channel extends through the center and the upper and lower channels extend only to the center. Rather, a vertical channel extending between the front and rear edges of the deck could be provided in combination with a left horizontal channel and a right horizontal channel which extend from their respective side edges to the center.

Since the lower deck 14' of FIG. 10 does not include separate retainers, when it is used to form a pallet, reinforcing elements 62 are retained in position by the walls of the channels 46 and the slots 35 formed on the downwardly extending legs 16 from the upper deck 12. Specifically, the reinforcing elements become captured between the upper and lower decks at the leg portions, and are thereby retained in the pallet structure. Notably, although the reinforcing elements are retained, they are still free to have some degree of movement relative to the upper and lower decks. This property is desired in that it minimizes the possibility of damage to the pallet that could result if the material forming the decks and the material forming the reinforcement elements are caused to undergo differing degrees of movement, such as when subjected to temperature variations which cause differing degrees of thermal expansion or contraction. For example, if the pallet were exposed repeatedly to temperatures which caused the pallet to expand, and if the reinforcements are mounted to the lower deck in a manner which does not allow relative movement between the lower deck and the reinforcing elements, differing degrees of thermal expansion could generate stress forces which could damage or weaken the pallet. In contrast, if relative movement between the lower deck and the reinforcing elements is allowed, such stress forces are minimized or eliminated, thereby minimizing the likelihood of damage occurring to the pallet.

Equivalents

Various modifications and alterations to this invention will become apparent to those skilled in the art without departing from the scope and spirit of this invention. Likewise, although the invention has been described in the context of plastic pallets, the term "pallet" is intended to encompass dunnage, trays and other material handling and supporting structures. It should be understood that this invention is not intended to be unduly limited by the illustrative embodiments and examples set forth herein and that such examples and embodiments are presented by way of example only with the scope of the invention intended to be limited only by the claims set forth herein as follows.

What is claimed is:

1. A reinforced plastic pallet comprising:

a) an upper deck formed of a plastic material having a first coefficient of thermal expansion, the upper deck having an upper surface, a lower surface, a front edge, a back edge substantially parallel to the front edge, first and second side edges which are substantially parallel to one another and a plurality of legs extending substantially perpendicularly downward from the lower surface;

b) a lower deck formed of a plastic material having substantially the first coefficient of thermal expansion, the lower deck having an upper surface, a lower surface, a front edge, a back edge substantially parallel to the front edge, first and second side edges which are substantially parallel to one another and a plurality of sockets sized and positioned to mate with the legs extending from the upper deck; the lower deck further including a plurality of channels formed in its upper surface; and c) a plurality of reinforcing elements having a second coefficient of thermal expansion different from the first degree of expansion, wherein each channel contains a reinforcing element, and further wherein at least one reinforcing element is capable of lateral movement within its channel independent of and relative to the upper and lower decks due to the different first and second coefficients of thermal expansion to minimize stress forces on the pallet.

2. The reinforced plastic pallet of claim 1, wherein each reinforcing element comprises a composite structural member of fiberglass reinforced plastic.

3. The reinforced plastic pallet of claim 2, wherein the reinforcing elements are fabricated from a pultrusion process.

4. The reinforced plastic pallet of claim 1, wherein each reinforcing element has an I-shaped cross sectional configuration.

5. The reinforced plastic pallet of claim 1, wherein the channels are positioned substantially adjacent to the front, back and side edges of the lower deck.

6. The reinforced plastic pallet of claim 5, which further includes a central channel extending substantially perpendicularly between the channels at the front and back edges and through the center of the deck.

7. The reinforced plastic pallet of claim 6, which further includes two subcentral channels, each extending substantially perpendicularly between the channels at the first and second sides and toward the center of the deck.

8. The reinforced plastic pallet of claim 5, which further includes a central channel extending substantially perpendicularly between the channels at the first and second side edges and through the center of the deck.

9. The reinforced plastic pallet of claim 8, which further includes two subcentral channels, each extending substantially perpendicularly between the channels at the front and back sides and toward the center of the deck.

10. The reinforced plastic pallet of claim 1, wherein the upper deck is secured to the lower deck by bolting, welding or adhering.

11. The reinforced plastic pallet of claim 1, wherein the upper deck is provided with a plurality of anti-slip plugs which extend between the upper and lower surface of the upper deck.

12. The reinforced plastic pallet of claim 11, wherein the anti-slip plugs are fabricated of rubber.

13. The reinforced plastic pallet of claim 1, wherein the upper deck includes nine legs, one leg extending downward from each comer, one leg extending downward from the middle of each edge, and one leg extending downward from the center.

14. The reinforced plastic pallet of claim 13, wherein the lower deck includes nine leg receiving sockets, one socket positioned at each comer, one socket positioned at the middle of each edge, and one socket positioned at the center.

15. The reinforced plastic pallet of claim 1, wherein at least one channel includes a plurality of retainers to retain a reinforcing element in a manner which allows relative movement between the channel and the reinforcing element, the retainers being staggered along alternate sides of the channels.

16. The reinforced plastic pallet of claim 1, wherein each channel includes a plurality of retainers to retain a reinforcing element in a manner which allows relative movement between the channel and the reinforcing element, the retainers being staggered along alternate sides of the channels.

17. The reinforced plastic pallet of claim 1, wherein each socket includes a drainage port.

* * * * *

UNITED STATES PATENT AND TRADEMARK OFFICE

CERTIFICATE OF CORRECTION

PATENT NO. : 6,199,488 B1
DATED : March 13, 2001
INVENTOR(S) : Favaron, et al.

It is certified that error appears in the above-identified patent and that said Letters Patent is hereby corrected as shown below:

Claim 14,
Line 10, change "comer" to -- corner --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*